US006739167B2

(12) United States Patent
Kobayashi et al.

(10) Patent No.: US 6,739,167 B2
(45) Date of Patent: May 25, 2004

(54) WORK ROLL FOR USE IN ROLLING APPARATUS

(75) Inventors: Keigo Kobayashi, Tochigi (JP); Norikazu Inaba, deceased, late of Tochigi (JP), by Tomoko Inaba, legal representative; Takashi Tamura, Chiba (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 10/355,249

(22) Filed: Jan. 31, 2003

(65) Prior Publication Data

US 2003/0167816 A1 Sep. 11, 2003

Related U.S. Application Data

(63) Continuation-in-part of application No. 09/646,607, filed as application No. PCT/JP99/01596 on Mar. 29, 1999, now abandoned.

(30) Foreign Application Priority Data

Mar. 31, 1998 (JP) ..... 10-85369

(51) Int. Cl.[7] ..... B21H 8/02
(52) U.S. Cl. ..... 72/197; 72/252.5
(58) Field of Search ..... 72/187, 188, 197, 72/252.5

(56) References Cited

U.S. PATENT DOCUMENTS

| | | | |
|---|---|---|---|
| 2,071,866 | A | 2/1937 | Sloan |
| 3,616,159 | A | 10/1971 | Kamp |
| 3,648,502 | A | 3/1972 | Klug et al. |
| 3,996,780 | A | 12/1976 | German |
| 4,068,366 | A | 1/1978 | Hillesheim |
| 4,614,632 | A | 9/1986 | Kezuka et al. |

FOREIGN PATENT DOCUMENTS

| | | |
|---|---|---|
| EP | 0 781 610 A2 | 7/1997 |
| JP | 53-46262 | 11/1978 |
| JP | 57-088905 A | 6/1982 |
| JP | 2-151334 A | 6/1990 |
| JP | 6-23602 | 3/1994 |
| JP | 9-182928 | 7/1997 |
| WO | WO 95/05571 A2 | 2/1995 |

*Primary Examiner*—Lowell A. Larson
(74) *Attorney, Agent, or Firm*—Armstrong, Kratz, Quintos, Hanson & Brooks, LLP

(57) ABSTRACT

A work roll for use in rolling apparatus for producing from a metal blank sheet articles having a deformed cross section and comprising, for example, a plate portion, and a plurality of upright walls formed on one surface of the plate portion integrally therewith and arranged as spaced apart from one another, such as flat heat exchange tube component members, heat sinks and lead frames. The work roll assures more simplified production work and provides surface finishes with higher accuracy than conventionally. The work roll comprises different kinds of disks having different diameters and arranged alternately on an axis into juxtaposed layers as secured to one another. Large disks 20A, 20B, are arranged at respective portions not forming the upright walls, and small disks 21A, 21B smaller than the large disks 20A, 20B in radius by an amount corresponding to the height of the upright walls are arranged at respective portions for forming the upright walls. Each of the disks 20A, 20B, 21A, 21B has an outer peripheral surface serving as a working surface.

7 Claims, 6 Drawing Sheets

WORK ROLL FOR USE IN ROLLING APPARATUS

This application is a Continuation-in-part of prior application Ser. No. 09/646,607 filed Sep. 20, 2000 ABN. [which is a national stage application under §371 of international application PCT/JP99-01596 filed Mar. 29, 1999.]

TECHNICAL FIELD

The present invention relates to work rolls for use in rolling apparatus for producing articles of deformed cross section, such as flat heat exchange tube component members, heat sinks and lead frames, from a metal blank sheet.

BACKGROUND ART

For example, component members of flat heat exchange tubes which comprise a flat plate portion and a plurality of upright walls formed on one surface of the plate portion integrally therewith and arranged as spaced apart from one another are produced by passing a metal blank sheet through a rolling apparatus wherein one of work rolls has a plurality of upright wall shaping annular grooves formed in the peripheral surface of the roll over the entire circumference thereof as is already known (see JP-A No. 182928/1997).

Conventionally used as such a work roll for rolling apparatus is one comprising a hollow cylindrical body which is integrally formed in its entirety and has a plurality of upright wall shaping annular grooves formed in its outer peripheral surface. The annular grooves are formed by subjecting the outer peripheral surface of the integrally formed cylindrical body to cutting, grinding and electrical discharge machining operations, and subsequently polishing the inner peripheral surfaces of the annular grooved portions to smooth finishes and obtain the conventional work roll.

However, the conventional work roll described has the following problems. In the case where the upright walls of the component member to be produced for the flat heat exchange tube have a small thickness and a great height, the upright wall shaping annular grooves have a small width and a great depth, whereas difficulties are then encountered in forming the annular grooves by cutting, grinding and electrical discharge machining and also in finishing the inner peripheral surfaces of the annular grooved portions by polishing. Accordingly, the fabrication of the entire work roll requires cumbersome work, a prolonged period and an increased cost. Moreover, since the inner peripheral surfaces defining the annular grooves are difficult to finish by polishing, the grooved inner peripheral surfaces are finished with low accuracy giving an impaired surface quality to the heat exchange component member obtained. Further if the work roll becomes locally worn or damaged, there arises a need to produce the entire work roll anew for replacement, consequently necessitating a prolonged period of time and an increased cost for the production and replacement of the work roll.

Especially in the case where it is required to form cutouts in the upper edges of the upright walls of the heat exchange tube component member to be produced, there is a need to form cutout shaping projections on the bottom surfaces of the annular grooved portions of the work roll. This presents difficulties in machining the grooved portions and finishing the peripheral surfaces of the projections, necessitating more cumbersome work for producing the work roll in its entirety, a further extended period for the production and a higher production cost. Additionally, the projection surfaces will be finished with lower accuracy to give an impaired quality to the cutout surfaces.

An object of the present invention is to overcome the foregoing problems and to provide a work roll which is easier to make and which is given higher surface finish accuracy than conventionally for use in rolling apparatus.

DISCLOSURE OF THE INVENTION

The present invention provides a work roll for rolling apparatus which comprises different kinds of disks having different diameters and arranged on an axis into juxtaposed layers as secured to one another, the disks of each kind being used in a specified number, each of the disks having an outer peripheral surface serving as a working surface.

When thus constructed, the work roll can be fabricated by making the individual disks, arranging the disks into juxtaposed layers and securing the disks to one another. Since the individual disks can be produced more easily than the conventional work roll, the roll can be produced within a shortened period of time at a lower cost. Since the peripheral surfaces of the individual disks can be finished by polishing easily, the surfaces can be finished with improved accuracy to give an excellent surface quality to the product obtained. Further even if one of the disks becomes locally worn or damaged, the worn or damaged disk only needs to be replaced by a corresponding disk which alone is to be prepared anew. This shortens the time required for the replacement and results in a reduced cost.

The work roll of the invention is used in a rolling apparatus for producing an article having a deformed cross section and comprising a plate portion, and a plurality of upright walls formed on one of opposite surfaces of the plate portion integrally therewith and arranged as spaced apart from one another. In this case, large disks are arranged at respective portions not forming the upright walls, and small disks smaller than the large disks in radius by an amount corresponding to the height of the upright walls are arranged at respective portions for forming the upright walls.

When the article of deformed cross section to be produced and comprising a plate portion, and a plurality of upright walls formed on one of opposite surfaces of the plate portion integrally therewith and arranged as spaced apart from one another must be formed with cutouts in the upper edges of the upright walls, the outer peripheral surfaces of the small disks are formed with projections for shaping the cutouts. To form the projections, the small disks can be machined more easily than when the bottom surfaces of the annular grooved portions of the cylindrical body are machined to form the cutout shaping projections in producing the conventional work roll. Moreover, the peripheral surfaces of the projections can be finished also easily. Accordingly the work of producing the work roll in its entirety is not very cumbersome as compared with the case wherein no projections are formed on the small disks, consequently necessitating only a slightly longer period for the fabrication of the work roll and a slightly increased production cost. Since the peripheral surfaces of the projections are easy to finish, the finished surfaces have improved accuracy to give an excellent quality to the interior surfaces defining the cutouts.

The present invention provides a rolling apparatus which comprises a central work roll and a plurality of planetary work rolls arranged around the central work roll and spaced apart cicumferentially thereof, at least one of the central work roll and the planetary work rolls being one of the work rolls of the invention described.

The invention further provides a rolling apparatus which comprises two work rolls in a pair, at least one of the two work rolls being one of the work rolls of the invention described.

BEST MODE OF CARRYING OUT THE INVENTION

The best mode of carrying out the invention will be described below with reference to the drawings.

In the following description, the term "aluminum" includes aluminum alloys in addition to pure aluminum.

Figure 1:
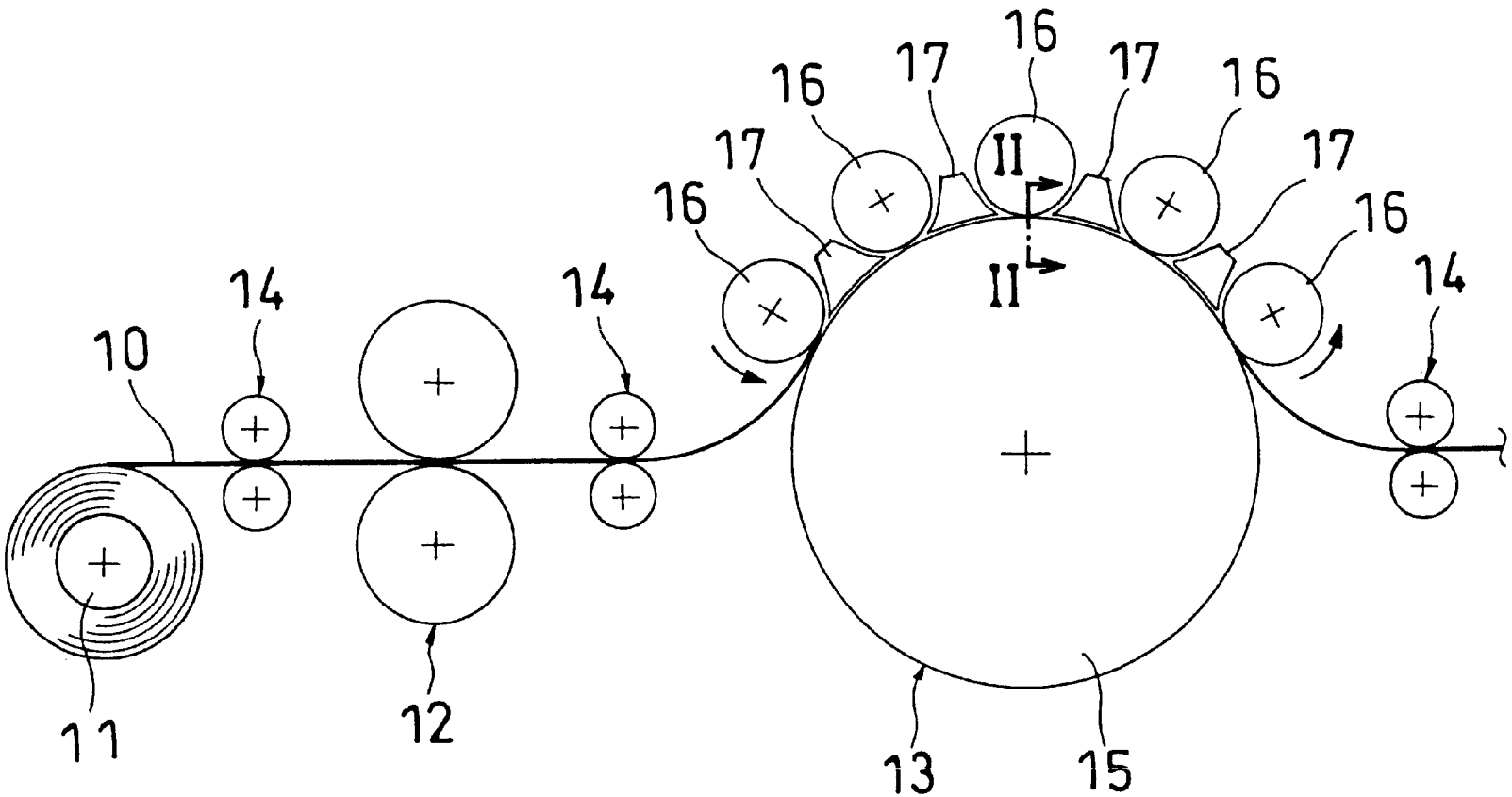
FIG. 1 is a diagram showing a rolling plant for producing lower component members of flat tubes for use in heat exchangers, the plant comprising a rolling apparatus wherein a work roll of the invention is used as its central roll.
Figure 7:
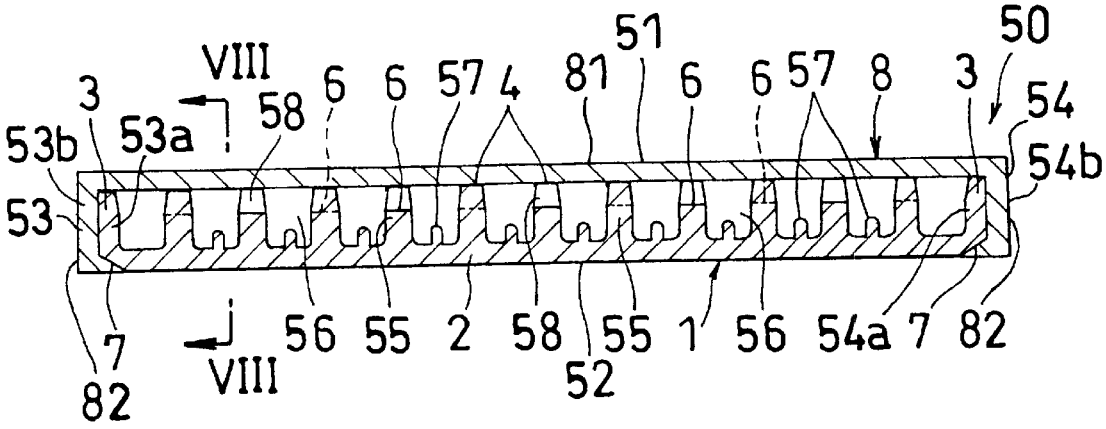
FIG. 7 is a view in cross section of the heat exchanger flat tube comprising the lower component member to be produced by the rolling plant shown in FIG. 1.
Figure 8:
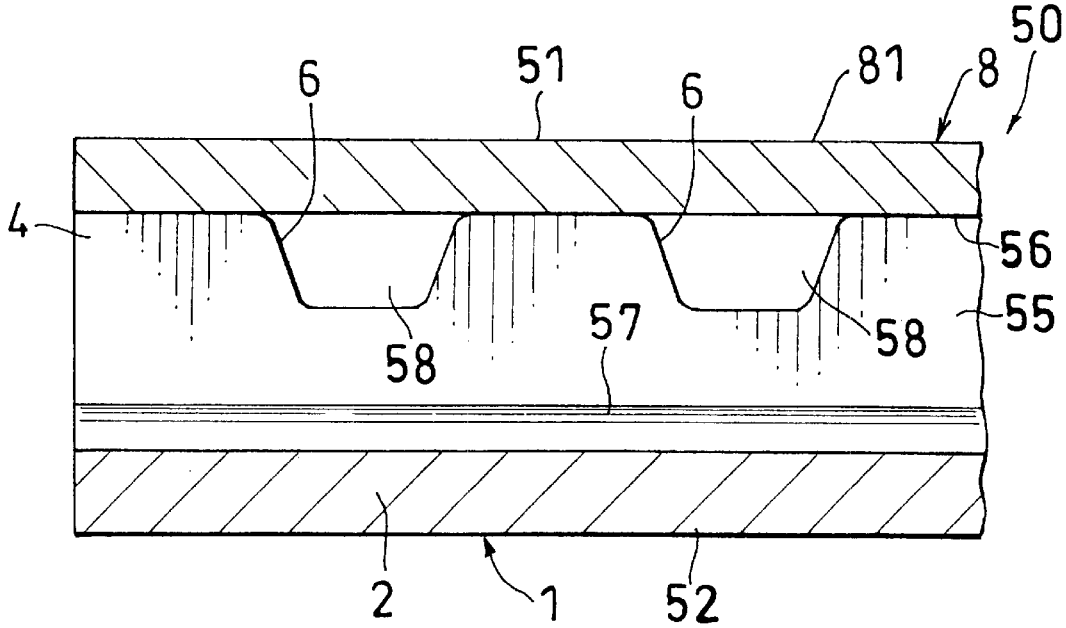
FIG. 8 is an enlarged view in section taken along the line VIII—VIII in FIG. 7.
Figure 9:
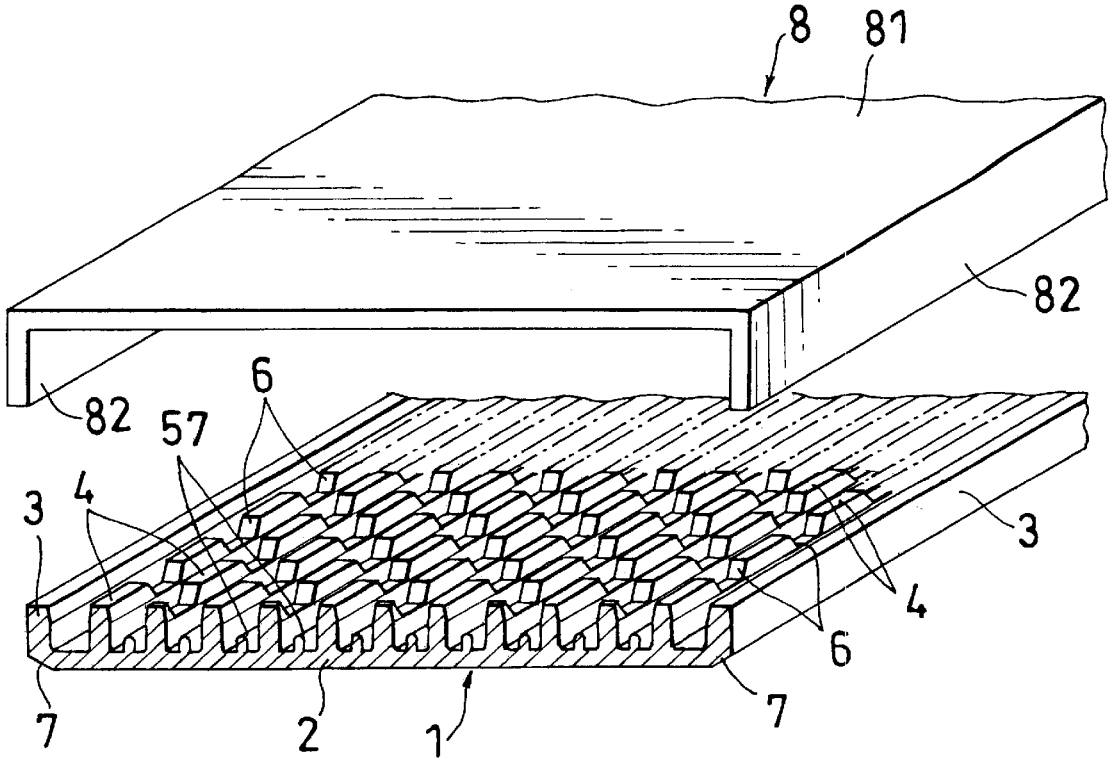
FIG. 9 is a fragmentary perspective view showing how to combine the lower component member and an upper component member into the heat exchanger flat tube.

FIG. 1 shows a rolling plant in its entirety which includes a rolling apparatus comprising a work roll of the present invention as its central work roll, FIGS. 2 to 6 show the work roll embodying the invention for use in the rolling apparatus, and FIGS. 7 to 9 show a lower component member of deformed cross section to be produced to provide heat exchanger flat tubes.

FIGS. 7 and 8 show a flat heat exchange tube 50, which comprises flat upper and lower walls 51, 52, left and right side walls 53, 54 of double structure interconnecting the upper and lower walls 51, 52 at the left and right side edges thereof, respectively, and a plurality of reinforcing walls 55 interconnecting the upper and lower walls 51, 52, extending longitudinally of the tube and spaced apart from one another by a predetermined distance, as arranged between the opposite side walls 53, 54. The tube has parallel fluid channels 56 in its interior. Between each pair of adjacent reinforcing walls 55, a low ridge 57 extending in the longitudinal direction for giving an increased heat transfer area is provided in the form of an upward protrusion on the inner surface of the lower wall 52 integrally therewith. Communication holes 58 are formed in the reinforcing walls 55 for holding the parallel fluid channels 56 in communication with one another. When seen from above, the communication holes 58 are in a staggered arrangement. When the tube has the communication holes 58, fluid portions flowing through the respective parallel channels 56 flow widthwise of the heat exchange tube 50 through the holes 58, spreading over all the fluid channels 56 to become mixed together and eliminating temperature differences in the fluid between the channels 56. This results in an improved heat exchange efficiency.

The flat heat exchange tube 50 comprises a lower component member 1 of aluminum providing the lower wall 52, inner portions 53*a*, 54*a* of the opposite side walls 53, 54 and the reinforcing walls 55; and an upper component member 8 of aluminum providing the upper wall 51 and outer portions 53*b*, 54*b* of the opposite side walls 53, 54. The lower component member 1 is produced by the rolling apparatus incorporating the work roll of the invention.

With reference to FIGS. 7 to 9, the lower component member 1 comprises a flat rectangular lower wall forming portion 2 (plate portion), side wall forming portions 3 (upright walls) extending upward from respective opposite side edges of the lower wall forming portion 2 integrally therewith, and a plurality of reinforcing wall forming portions 4 (upright walls) upstanding from the lower wall forming portion 2 integrally therewith, spaced apart from one another as arranged between the side wall forming portions 3 on the portion 2 and extending longitudinally of the portion 2. Ridges 57 each in the form of an upward protrusion are formed on the upper surface of the lower wall forming portion 2 integrally therewith. Trapezoidal cutouts 6 are formed in the upper edges of reinforcing forming walls 4 in a staggered arrangement when seen from above and spaced apart by a predetermined distance longitudinally thereof. The lower wall forming portion 2 of the lower component member 1 is formed with a slope 7 slanting outwardly upward at each of opposite side edges of its lower surface. The side wall forming portions 3 of the lower component member 1 have the same height as the reinforcing wall forming portions 4. The lower component member 1 is made from an aluminum brazing-sheet having a brazing material layer (not shown) on its outer surface, i.e., on the lower surface of the lower wall forming portion 2 and on the outer surfaces of the side wall forming portions 3.

The upper component member 8 comprises a flat rectangular upper wall forming portion 81, and side wall forming portions 82 extending downward from opposite side edges of the upper wall forming portion 81 integrally therewith. The upper component member 8 is made from an aluminum brazing sheet having a brazing material layer (not shown) on its opposite surfaces by roll forming. The upper wall forming portion 81 and the side wall forming portions 82 have the brazing material layer (not shown) on their opposite surfaces.

The flat heat exchange tube 50 is prepared by fitting the upper component member 8 over the lower component member 1 as shown in FIG. 9, with their side wall forming portions 82 lapping over the respective side wall forming portions 3, inwardly bending the lower ends of the side wall forming portions 82 into intimate contact with the slops 7 to temporarily hold the two component members 1, 8 together and brazing the two component members 1, 8. The communication holes 58 are formed by closing the openings of the cutouts 6 in the reinforcing wall forming portions 4 of the lower component member 1 with the upper wall forming portion 81 of the upper component member 8.

With reference to FIG. 1, the rolling plant for producing the lower component member 1 comprises an uncoiler 11 having wound up thereon an aluminum brazing sheet 10 (metal blank sheet) formed with a brazing material layer on one side thereof so that the brazing material layer is positioned outside, a preliminary rolling mill 12, a finishing rolling apparatus 13 and transport rolls 14. The aluminum brazing sheet 10 on the uncoiler 11 is paid out from the uncoiler 11, fed to and passed through the preliminary rolling mill 12, and thereafter fed to the rolling apparatus 13 and thereby rolled for finishing, whereby the lower component member 1 is produced.

The preliminary rolling mill 12 forms on the aluminum brazing sheet 10 ridges corresponding to the side wall forming portions 3 and the reinforcing wall forming portions 4.

The rolling apparatus 13 comprises a central work roll 15, a plurality of planetary work rolls 16 arranged around the central work roll 15 and equidistantly spaced apart circumferentially of the roll 15, and trapezoidal guide shoes 17 arranged between the adjacent planetary work rolls 16. The central work roll 15 is a work roll of the invention.

With reference to FIGS. 2 to 6, the central work roll 15 comprises large and small two kinds of disks 20A, 20B, 21A, 21B arranged alternately on an axis into juxtaposed layers and clamped between a pair of flanges 22A, 22B at left and right opposite sides of the arrangement and secured to one another. The disks 20A, 20B, 21A, 21B are made from die steel, high-speed tool steel, cemented carbide or the like. The large disks 20A, 20B are arranged at the respective portions not forming the side wall forming portions 3 and the reinforcing wall forming portions 4 on the lower component member. The small disks 21A, 21B are arranged at the respective portions for forming the side wall forming portions 3 and the reinforcing wall forming portions 4 on the lower component member 1. Accordingly, annular grooves 23' for shaping the side wall forming portions are defined by the large disks 20A at the left and right ends, the small disks 21A at the left and right ends and the flanges 22A, 22B. An annular groove 24 for shaping the reinforcing wall forming portion is defined by each pair of adjacent large disks 20A, 20B and the small disk 21B therebetween.

Each of the large disks 20B other than the large disks 20A at the opposite ends is formed in its outer peripheral surface with a ridge shaping annular recess over the entire circumference thereof. The radius of the small disks 21A, 21B is smaller than the radius 5 of the large disks 20A, 20B by an amount corresponding to the height of the side wall forming portions 3 and the reinforcing wall forming portions 4. The small disks 21B other than the small disk 20A at the opposite ends are each formed in the outer peripheral surface thereof with a plurality of cutout shaping projections 26 arranged at a spacing circumferentially thereof. Since the cutouts 6 are in a staggered arrangement, one of the adjacent small disks 21B has its projections 26 arranged as circumferentially shifted from those of the other.

Opposite surfaces of the disks 20A, 20B, 21A, 21B and the surfaces of the flanges 22A, 22B axially inward of the work roll are each in the form of a vertical surface, and each pair of adjacent disks 20A, 20B, 21A, 20 21B, as well as each of the flanges 22A, 22B and the disk 21A, are in intimate contact with each other. The outer peripheral portion of each of the large disks 20A, 20B, 21A, 21B projecting radially outward beyond the projections 26 on the small disk 21B is tapered toward the outer peripheral edge with a gradually reducing thickness so as to render the lower component member 1 as formed easily removable from the work roll 15.

The gradually reducing thickness of the tapered portion of the outer peripheral portion is shaped to provide a cone angle of the tapered portion of the large disks of 2 to 10 degrees, preferably 4 to 8 degrees, and most preferably 6 to 8 degrees. Also, a difference between the radius of the large disk and that of the small disk is 0.5 to 2.5 mm. preferably between 0.8 to 1.5 mm, so as to best render the lower component member 1, as formed, more easily removable from the work roll 15.

A drive shaft insertion bore (not shown) extends through both flanges 22A, 22B, all the large disks 20A, 20B and all the small disks 21A, 21B centrally thereof. Further a key groove forming cutout (not shown) is formed in a portion of the inner periphery of each of the flanges 22A, 22B, the large disks 20A, 20B and the small disks 21A, 21B which defines the shaft insertion bore. A plurality of bolt insertion bores 27 extend through the left flange 22A, all the large disks 20A, 20B and all the small disks 21A, 21B and are arranged on the circumference of a portion of each of these disks around the shaft insertion bore and spaced apart circumferentially. A plurality of internally threaded bores 28 are formed in the right flange 22B on the circumference of a portion thereof around the shaft insertion bore and spaced apart circumferentially. The bolt insertion bores in all the large disks 20A, 20B and all the small disks 21A, 21B are not shown. Bolts 29 inserted through the bores 27 in the left flange 22A, all the large disks 20A, 20B and all the small disks 21A, 21B from the left side are screwed at their threaded ends into the respective threaded bores 28 in the right flange 22B, whereby all the large disks 20A, 20B and all the small disks 21A, 21B are secured to one another as clamped between the two flanges 22A, 22B.

The large disks 20A, 20B and the small disks 21A at the opposite ends are prepared in the following manner. Metal plates of die steel, high-speed tool steel, cemented carbide or the like are machined by blanking or lathing to obtain disks having specified outside diameters and a drive shaft insertion bore. Each disk is then heat-treated and worked by electrical discharge wire cutting to shape a key groove forming cutout in the bored portion and shape bolt insertion bores. Subsequently, the inner periphery of the disk defining the drive shaft bore is finished by a jig grinding machine. The disk is thereafter finished over opposite surfaces by surface polishing and has its outer peripheral surface finished by cylindrical polishing. Each of the disks for the large disks 20A, 20B is then slightly tapered by profile grinding at its outer peripheral portion. Each of the disks for the large disks 20B other than the large disks 20A at the opposite ends is worked on its outer peripheral surface by profile grinding to form a ridge shaping annular recess 25. In this way, the large disks 20A, 20B and the small disks 21A at the opposite ends are produced.

The small disks 21B other than the small end disks 21A are produced in the following manner. A metal plate of die steel, high-speed tool steel, cemented carbide or the like is machined by blanking to obtain disks having a specified outside diameter and a drive shaft insertion bore. These disks are greater in radius than the disks blanked out for preparing the small end disks 21A by an amount corresponding to the height of the cutout shaping projections 26. The subsequent sequence of steps up to the finishing work by surface polishing and cylindrical polishing is the same as is the case with the preparation of the large disks 20A, 20B and the small end disks 21A. The recessed portions to be present between the adjacent cutout shaping projections 26 are then formed. Finally the inner faces of the recessed portions are finished by polishing. In this way, the small disks 21B are produced.

Although each small end disk 21A and the large end disk 20A are separate members according to the construction described, the outer periphery of the small end disk 21A has no cutout shaping projections and is in the form of a cylindrical face, so that the small end disk may be made integral with the large end disk 20A.

Figure 2:
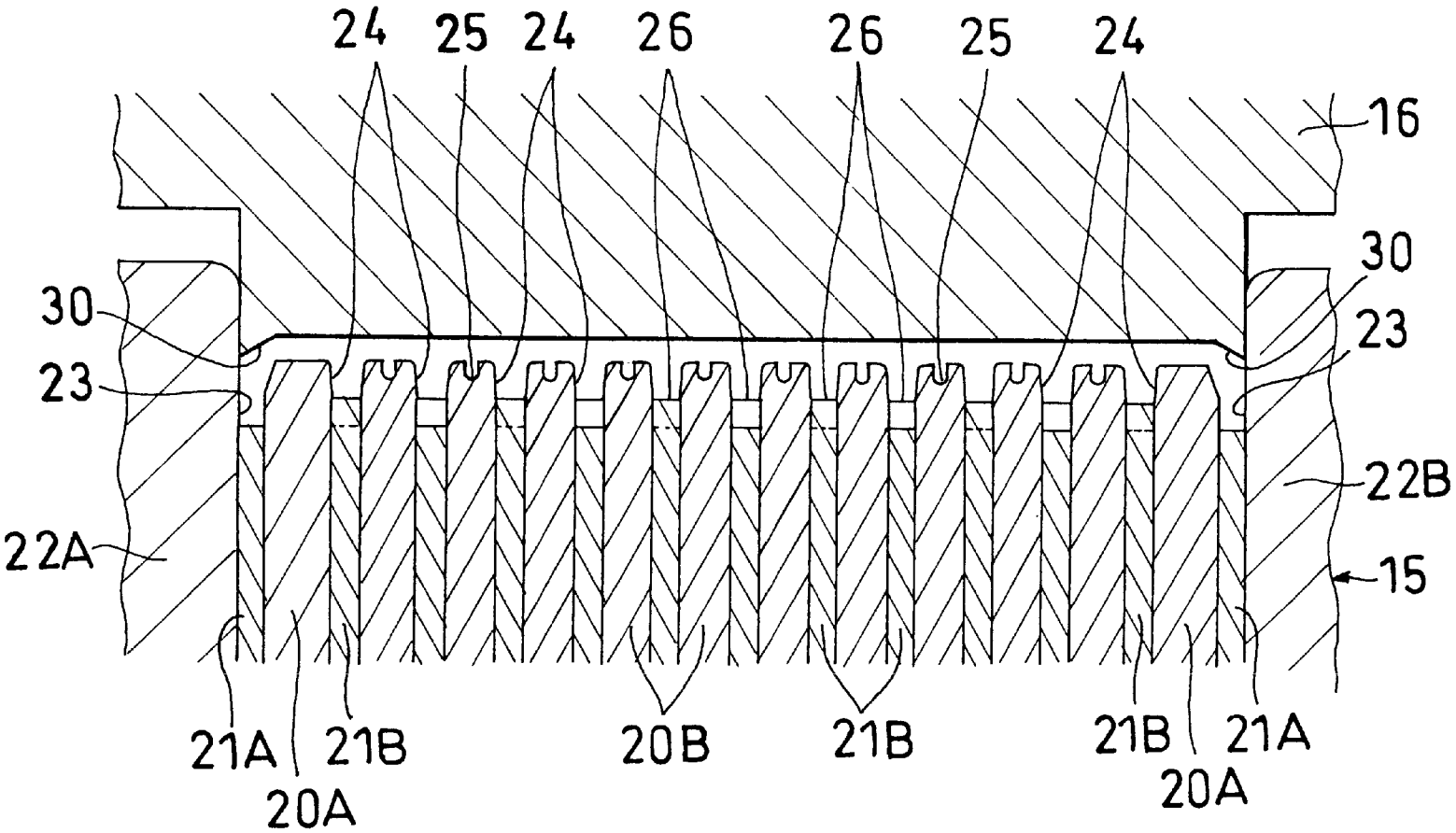
FIG. 2 is an enlarged view in section taken along the line II—II in FIG. 1.
Figure 3:
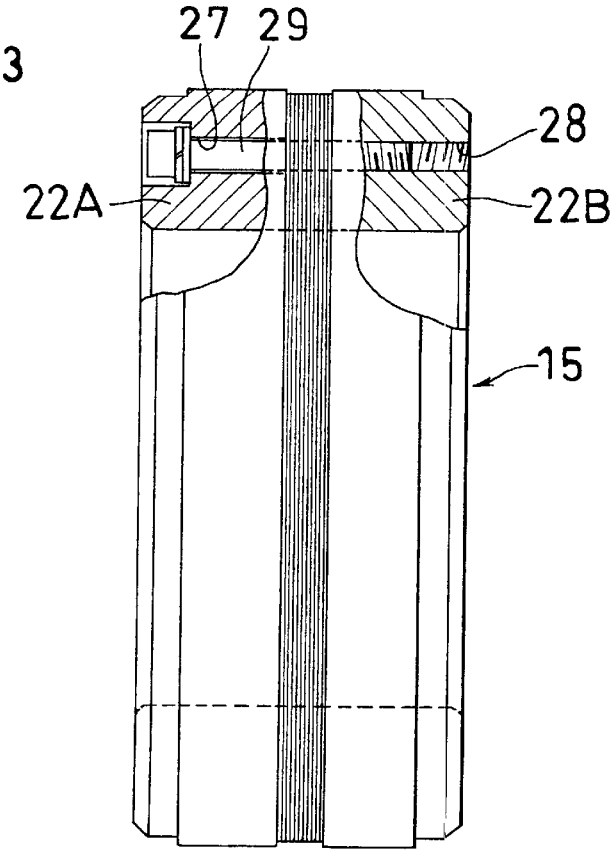
FIG. 3 is a front view partly broken away and showing the central work roll of the rolling apparatus.
Figure 4:
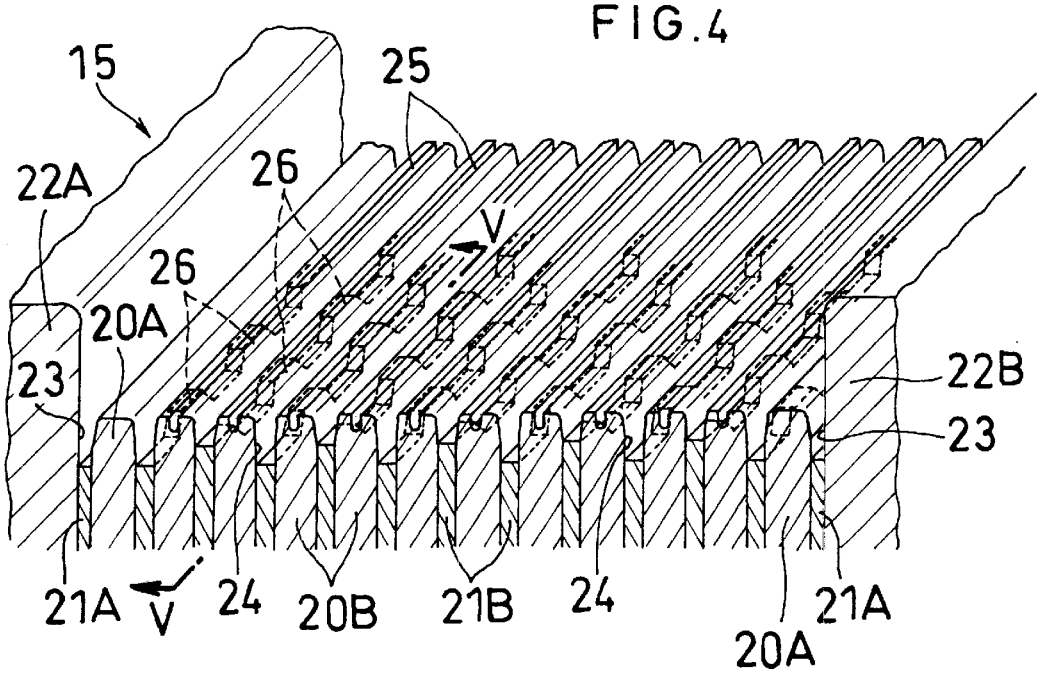
FIG. 4 is a fragmentary enlarged perspective view showing the central work roll of the rolling apparatus, with the peripheral surface of the roll developed in a plane.
Figure 5:
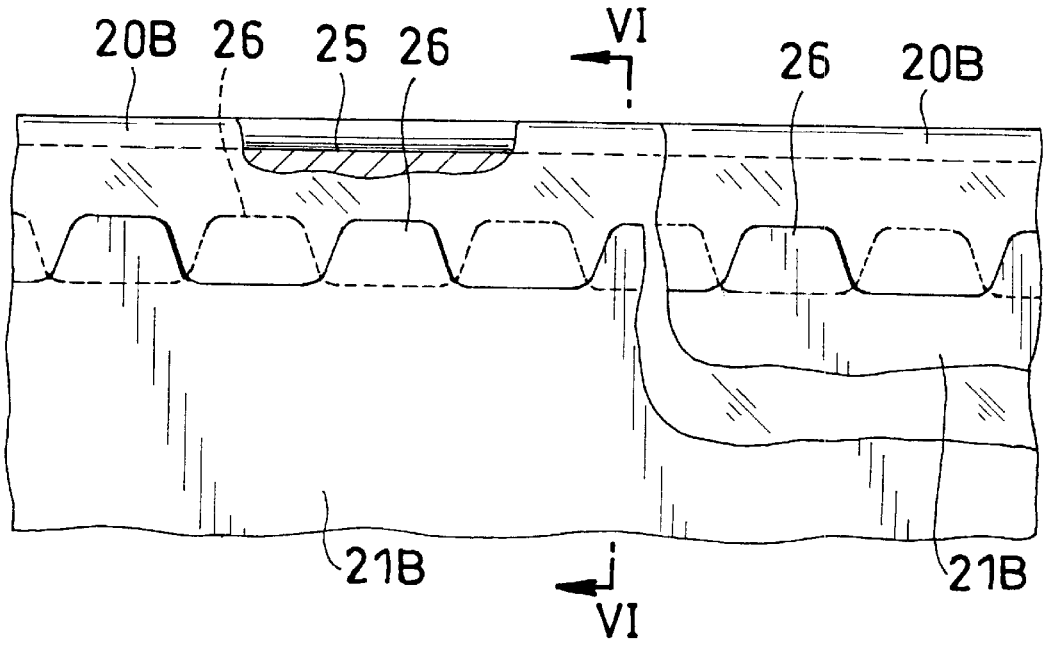
FIG. 5 is an enlarged view partly broken away and in section taken along the line V—V in FIG. 4.
Figure 6:
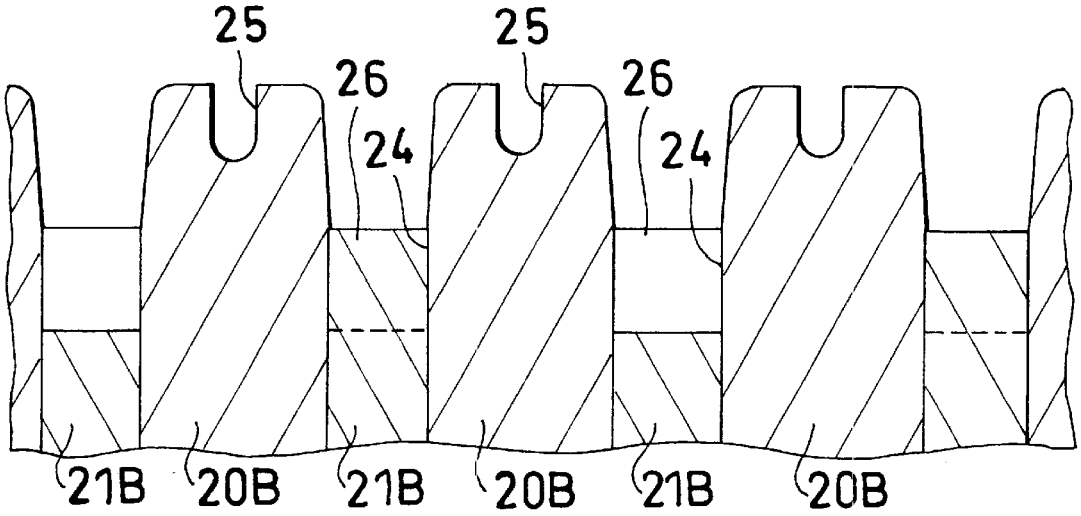
FIG. 6 is a view in section taken along the line VI—VI in FIG.

As shown in FIG. 2, the peripheral surface of the planetary work roll 16 has a slope shaping portion 30 formed at each of its axial opposite ends and having a diameter increasing axially outward. The planetary work rolls 16 are coupled to the central work roll 15 by unillustrated gear means, such that the rotation of the central work roll 15 rotates all the planetary work rolls 16 at the same peripheral speed as the central work roll 15. Incidentally, each planetary work roll 16 may be provided with drive means for rotating the work roll 16 at the same peripheral speed as the central work roll 15.

When an aluminum brazing sheet 10 is continuously passed between the central work roll 15 and all the planetary work rolls 16, the grooves 23, 24, the annular recesses 25 and the projections 26 of the central work roll 15, and the slope shaping portions 30 of the planetary work rolls 16 are completely transferred to the aluminum brazing sheet 10, whereby the lower component member 1 having the desired configuration and as shown in FIGS. 7 to 9 is shaped.

The work roll of the invention is used as the central work roll 15 according to the foregoing embodiment, whereas work rolls of the invention may alternatively be used as planetary work rolls 16.

Further according to the embodiment described, the article of deformed cross section to be produced is a lower component member which has upright walls on only one surface of a plate portion for use in flat heat exchangers, so that the annular grooves 23, 24 for shaping the upright walls are formed only in the central work roll. However, in the case where the article of deformed cross section to be produced has upright walls on both surfaces of a plate portion, the planetary work rolls 16 may also be formed with annular grooves for shaping upright walls. In this case, work rolls of the invention are used as the planetary work rolls 16.

Further according to the embodiment described, a so-called satellite rolling apparatus comprising a central work roll and a plurality of planetary work rolls arranged around the central work roll has incorporated therein the work roll of the invention for use as the central work roll, whereas the work roll of the invention is usable also for usual rolling apparatus which comprise two work rolls in a pair to serve as the work roll. In the case where the article of deformed cross section to be produced has upright walls on only one side, the work roll of the invention formed with annular grooves for forming the upright walls is used as one of the pair of work rolls. In the case where the article of deformed cross section to be produced has upright walls on both sides thereof, work rolls of the invention each having annular grooves for shaping the upright walls are used as the respective work rolls of the pair.

Industrial Applicability

As described above, the work roll of the present invention for rolling apparatus is suitable as a work roll for use in rolling apparatus for producing articles of deformed cross section, such as flat heat exchange tube component members, heat sinks and lead frames, from a metal blank sheet.

What is claimed is:

1. A rolling apparatus for producing component members of heat exchange tubes forming flat heat exchange tubes comprising a pair of flat walls opposed to each other, two side walls connected between opposite side edges of the opposite flat walls, and a plurality of reinforcing walls connected between the opposite flat walls, extending longitudinally of the tube and spaced apart from one another by a predetermined distance, the component members of heat exchange tubes having flat wall forming portions, reinforcing wall forming portions and side wall forming portions projecting from the flat wall forming portions integrally therewith, the rolling apparatus comprising:

a central work roll; and a plurality of planetary work rolls arranged around the central work roll and spaced apart circumferentially thereof, annular grooves for shaping the reinforcing wall forming portions and the side wall forming portions provided in a peripheral surface of one of the central work roll and the planetary work rolls;

the work roll provided with the annular grooves having different kinds of disks having different outside diameters and arranged on an axis into juxtaposed layers and secured to one another, the disks of each kind being used in a specific number, each of the disks having an outer peripheral surface serving as a working surface;

wherein the different kinds of disks are large disks, of a common diameter, arranged at respective portions not forming the reinforcing wall forming portions and side wall forming portions, and small disks, of a common diameter, smaller than the large disks in radius by an amount corresponding to the height of the reinforcing wall forming portions and the side wall forming portions, arranged at respective portions for forming the reinforcing wall forming portions and the side wall forming portions, an outer peripheral portion of the large disks of the work roll projecting radially outward beyond the small disks is tapered toward an outer peripheral edge thereof with a gradually reducing thickness, and a cone angle of the tapered portion of the large disk is 2 to 10 degrees.

2. A rolling apparatus according to claim 1, wherein the outer peripheral surface of each of the small disks other than the small disks at the opposite ends of the work roll is formed with projections for forming cutouts in an edge of reinforcing wall forming portions of component members of heat exchange tubes to be produced.

3. A rolling apparatus according to claim 1 wherein the outer peripheral surface of the large disks other than large disks at the opposite ends of the work roll is formed with ridge forming annular recesses extending longitudinally of the flat wall forming portions of the component members of heat exchange tubes to be produced.

4. A rolling apparatus according to claim 1, wherein a cone angle of the tapered portion of the large disk is 4 to 8 degrees.

5. A rolling apparatus according to claim 1, wherein a cone angle of the tapered portion of the large disk is 6 to 8 degrees.

6. A rolling apparatus according to claim 1, wherein a difference between the radius of the large disk and that of the small disk is 0.5 to 2.5 mm.

7. A rolling apparatus according to claim 1, wherein a difference between the radius of the large disk and that of the small disk is 0.8 to 1.5 mm.

* * * * *